US007578269B2

(12) United States Patent
Meintschel et al.

(10) Patent No.: US 7,578,269 B2
(45) Date of Patent: Aug. 25, 2009

(54) ADJUSTING APPARATUS PARTICULARLY FOR AN INTERNAL COMBUSTION ENGINE

(75) Inventors: Jens Meintschel, Esslingen (DE); Tilmann Römheld, Waiblingen (DE); Thomas Stolk, Kirchheim (DE); Alexander von Gaisberg-Helfenberg, Graz (DE)

(73) Assignee: Daimler AG, Stuttgart (DE)

( * ) Notice: Subject to any disclaimer, the term of this patent is extended or adjusted under 35 U.S.C. 154(b) by 117 days.

(21) Appl. No.: 11/978,153

(22) Filed: Nov. 9, 2007

(65) Prior Publication Data

US 2008/0078338 A1 Apr. 3, 2008

Related U.S. Application Data

(63) Continuation-in-part of application No. PCT/EP2006/003621, filed on Apr. 20, 2006.

(30) Foreign Application Priority Data

Apr. 30, 2005 (DE) ..... 10 2005 020 261

(51) Int. Cl.
*F02D 15/02* (2006.01)

(52) U.S. Cl. ..... 123/78 E; 123/48 B; 123/197.4

(58) Field of Classification Search ..... 123/48 B, 123/78 E, 197.1, 197.3, 197.4
See application file for complete search history.

(56) References Cited

U.S. PATENT DOCUMENTS 1,687,425 A * 10/1928 Briggs ..... 74/50
3,985,114 A 10/1976 Vallejos
4,078,450 A * 3/1978 Vallejos ..... 74/581
4,254,743 A * 3/1981 Reid et al. ..... 123/48 B
4,515,114 A 5/1985 Dang
4,687,348 A * 8/1987 Naruoka et al. ..... 384/255
4,721,073 A * 1/1988 Naruoka et al. ..... 123/78 BA
2004/0025814 A1 2/2004 Gray, Jr.

FOREIGN PATENT DOCUMENTS

| | | |
|---|---|---|
| DE | 44 02 704 | 8/1995 |
| DE | 198 44 20 | 6/1999 |
| DE | 101 57 616 | 6/2003 |
| DE | 102 30 429 | 1/2004 |
| DE | 103 30 871 | 1/2005 |
| EP | 1 363 002 | 11/2003 |
| EP | 1 307 642 | 5/2004 |
| EP | 1 505 277 | 2/2005 |
| JP | 63 143342 | 6/1988 |
| JP | 2000 227010 | 8/2000 |
| JP | 2004 4316465 | 11/2004 |
| WO | WO 99/51869 | 10/1999 |

* cited by examiner

*Primary Examiner*—Hai H Huynh
(74) *Attorney, Agent, or Firm*—Klaus J. Bach

(57) ABSTRACT

In an adjusting apparatus, particularly for an internal combustion engine having cylinders arranged in an engine block, with a crankshaft and with pistons movably disposed in the cylinders, the adjusting apparatus includes a pick-up which causes an adjustment of an adjustable device, and an adjusting element which is operatively connected to the pick-up, the adjusting element being arranged movably on an adjusting shaft (9) which can be moved by an actuator translationally with a cone as adjusting element or rotationally with an eccentric (8) as adjusting element.

14 Claims, 3 Drawing Sheets

ADJUSTING APPARATUS PARTICULARLY FOR AN INTERNAL COMBUSTION ENGINE

This is a Continuation-in-Part application of pending International Patent Application PCT/EP2006/003621 filed Apr. 20, 2006 and claiming the priority of German Patent Application 10 2005 261.6 filed Apr. 30, 2005.

BACKGROUND OF THE INVENTION

The invention relates to an adjusting apparatus, particularly for an internal combustion engine having a housing with cylinders, pistons movably disposed in the cylinders by a crankshaft rotatably supported in the housing and connected to the pistons by piston rods and also to a method for operating an adjusting apparatus for such an internal combustion engine.

EP 1 307 642 B1 discloses a reciprocating-piston internal combustion engine with a variable compression ratio, in which a transverse lever is arranged between a connecting rod and the crankshaft and is itself supported by a secondary connecting rod. Furthermore, this secondary connecting rod is connected to an eccentric shaft via an eccentric. As a result of the rotation of the eccentric shaft and of the eccentric arranged on it, the secondary connecting rod is moved. The connecting rod and a piston fastened to it are thereby displaced by the transverse lever, whereby the compression ratio is changed. An adjustment of the eccentric shaft takes place by means of a separately switched motor or via a gear from the crankshaft of the internal combustion engine. During adjustment, depending on the position of the piston and of the connecting rod, considerable forces are to be overcome in order to adjust the entire active chain of mechanical transmission elements counter to the combustion pressure in the most unfavorable case. A similar problem arises with regard to actuating elements for controlling the gas exchange valves, within the active chain of which a fluctuating load likewise occurs. Here too, in the most unfavorable case, an adjustment of the profile of the valve lift counter to the overall spring force of the valve spring, plus, in addition, possible mass forces arising from the valve movement, is required.

It is the object of the present invention to provide an apparatus which, at low outlay in terms of energy, makes it possible to adjust a fluctuatingly stressed active chain of mechanical transmission elements.

SUMMARY OF THE INVENTION

In an adjusting apparatus, particularly for an internal combustion engine having cylinders arranged in an engine block, with a crankshaft and with pistons movably disposed in the cylinders, the adjusting apparatus includes a pick-up which causes an adjustment of an adjustable device, and an adjusting element which is operatively connected to the pick-up, the adjusting element being arranged movably on an adjusting shaft (9) which can be moved by an actuator translationally with a cone as adjusting element or rotationally with an eccentric (8) as adjusting element.

The pick-up, which is designed, for example, as a lever, causes an adjustment of an adjustable device of a cylinder segment. This device serves, for example, for adjusting the compression ratio or a stroke curve of a gas exchange valve. Furthermore, the adjusting apparatus has an adjusting element which is mounted movably on an adjusting shaft and which is operatively connected to the pick-up. The pick-up slides on the adjusting element. As a result of the movement of the adjusting element, the pick-up is moved via an oblique face on the adjusting element, such as, for example, an inclined plane. If the pick-up is designed as a lever, by means of this movement of the lever, for example, the position of a transverse lever in the crank mechanism of an internal combustion engine with a bendable connecting rod can be varied, with the result that the compression ratio is changed. Even in the case of a device for controlling the gas exchange valves, which makes it possible to vary the stroke curve of the gas exchange valves and which makes use, for example, of variable lever lengths on drag levers or rocker arms, it is possible to connect that side of the pick-up which faces away from the adjusting element to the device for controlling the gas exchange valves and to vary the stroke curve via this action on the active chain. The idea is, as a starting point, that, in the event of an adjustment of a setting of an internal combustion engine, such as, for example, the compression ratio or a valve stroke curve of a gas exchange valve, its load has a highly fluctuating value. In this case, it is advantageous to carry out adjusting movements counter to a fluctuating force exactly when the fluctuating force has a minimum value. Adjusting movements which are assisted in their movement by the fluctuating force can be executed at any desired time point.

In a refinement of the invention, the adjusting shaft can be moved translationally and/or rotationally by means of an actuator. The actuator is, for example, an electric motor activated by a control unit, a mechanical drive or a hydraulic drive. Depending on the design of the adjusting element, the actuator displaces or rotates the adjusting shaft, in order to bring about a change of the adjusting element arranged on it and consequently to initiate an adjusting operation via the pick-up.

In a further refinement of the invention, the operative connection between the adjusting element and the pick-up is self-locking. This means that an oblique face on the adjusting element, on which the pick-up slides during the adjusting operation, is inclined only so slightly that, even in the case of good frictional conditions, the adjusting element does not move on the adjusting shaft as a result of the force of the pick-up.

In a further refinement of the invention, the movement of the adjusting element on the adjusting shaft is limited by stops, in order thereby to obtain predetermined final values of the movement of the adjusting element and of the pick-up. First stops on the adjusting shaft limit the movement of the adjusting element by means of second stops on the adjusting element which are coordinated with them. The stops may be fixed in structural terms or they may be variable in their end positions by means of a movement of the adjusting shaft and consequently make it possible to have different final values. The main task of the stops, however, is to limit a movement of the adjusting element.

In a further refinement of the invention, on the adjusting apparatus, a spring is provided which assists the movement of the adjusting element on the adjusting shaft in one direction. Since, according to the invention, a frictional connection with self-locking is provided between the pick-up and the adjusting element, automatic adjustment due to a force of the pick-up on the adjusting element does not generally take place. If, however, the locking force of the self-locking can be overcome by means of a spring force, it is possible to initiate an adjusting operation by means of a force on the pick-up. In order to make this possible, the spring force is to be designed such that, in the tensioned state, it overcomes even the locking force of the self-locking. The spring is tensioned as a result of the movement of the adjusting shaft. The spring may be designed as a tension spring or compression spring.

In a further refinement of the invention, the adjusting element is designed as an eccentric which is mounted rotatably on the adjusting shaft. Stops which limit the movement of the adjusting element are arranged, as stops limiting the angle of rotation, on the eccentric and on the adjusting shaft. An eccentric constitutes a geometric conversion of an inclined plane to a circular body. During a rotation of the eccentric on or together with the adjusting shaft, a pick-up sliding on the eccentric face executes a movement which can be used for adjusting any desired apparatus. The self-locking according to the invention can be achieved in a simple way via the amount of eccentricity, that is to say via the distance between the axis of rotation and the center of the eccentric. In order to prevent an unlimited rotation of the eccentric and consequently an unlimited oscillation of the pick-up, the eccentric and the adjusting shaft are provided with stops. Furthermore, the stops serve for transmitting a rotational movement of the adjusting shaft to the eccentric.

In a further refinement of the invention, the adjusting element of the apparatus is in the form of a cone which is displaceable axially on the adjusting shaft. During a longitudinal movement of the cone on the adjusting shaft, a pick-up sliding on the cone face executes a movement which can be used for adjusting any desired apparatus. The self-locking according to the invention can be achieved in a simple way via the choice of the cone angle. By the adjusting element being a cone, the axial adjusting movement can have super-posed on it a rotational movement which makes it possible to provide for easier adjustment and activation with lower adjustment forces. It is also possible, however, to adjust the adjusting element axially only, without any rotational movement. Since, in this case, a cone is not absolutely necessary as an adjusting element, it is possible to provide as an adjusting element a body having an oblique face and capable of being displaced along the adjusting shaft. In order to prevent an unwanted axial displacement of the adjusting element, preferably two stops limiting the axial movement are provided on the adjusting shaft.

In a further refinement of the invention, the adjustable device of a cylinder segment forms an apparatus for adjusting the compression ratio of an internal combustion engine. In this case, by the movement of the pick-up, the length of a connecting rod, the stroke of the crankshaft or the geometry of other components determining the compression ratio of the internal combustion engine can be varied, for example via intermediate members.

In a further refinement of the invention, the end positions of the angle of rotation which are determined by stops correspond to a highest and a lowest compression ratio of the internal combustion engine. During adjustment, the adjusting element is in each case displaced as far as the stop and a highest or lowest compression ratio is thus set. If any desired intermediate value is required, it is possible to displace the stop correspondingly on, or together with, the adjusting shaft.

In a further refinement of the invention, the device forms an apparatus for adjusting the profile, size and/or shape of a valve stroke curve of gas exchange valves. Since transmission elements in the valve drive between a camshaft and the gas exchange valve, such as, for example, tappet pushrods, drag levers, or selecting levers or rocker arms, are subjected to fluctuating load, and, at the same time, in the event of action for varying the valve stroke curve, usually one or more members of this active chain are varied, it is advantageous for this to be carried out by means of the apparatus according to the invention. By means of the movement which is transmitted from the adjusting element to the pick-up, it is possible to take action at any desired point in the active chain between the camshaft and gas exchange valve and, for example, to change a lever length or an adjusting angle, in order thereby to adapt the valve stroke curve to another operating point. Since the load within the active chain is fluctuating, it is advantageous to carry out adjusting operations according to the forces within the active chain. That is to say, adjustment counter to the force in the active chain takes place only within the segments having a low force level, whereas adjustment in an opposite direction takes place with the assistance of the forces within the active chain.

The method according to the invention for operating an adjusting apparatus for the compression ratio of an internal combustion engine is distinguished in that a variation of the compression ratio in the direction of a low compression ratio takes place in that the adjusting shaft is moved in a first direction and moves the adjusting element by means of a stop. In this case, the gas pressure generated by the combustion in a combustion space above the piston assists the movement of the adjusting element via the pick-up. This method is employed in the situation where the growing gas force arising from combustion is utilized to assist the adjusting operation. This is the case with regard to adjustment from a high compression ratio in the direction of a low compression ratio. In this case, the pick-up slides or rolls downwards on the inclined plane of the adjusting element, that is to say the pick-up moves on the eccentric in the direction of the axis of rotation or the pick-up moves on the cone in the direction of the cone apex. Owing to the self-locking of the connection, the force generated by the gas pressure cannot by itself move the adjusting element, but it assists the adjusting operation when the adjusting operation is triggered by an actuator. The adjusting operation is initiated actively by the actuator. Since the actuator has to overcome only the friction and self-locking, but does not have to work counter to the gas force, only a low power for the adjusting operation is required, which can be furnished by an electric or hydraulic drive without major losses. The adjusting element, that is to say the eccentric or the cone, is moved on the adjusting shaft by a stop until the desired end position is reached. Further automatic adjustment does not occur due to the self-locking.

In a further refinement of the method, a variation of the compression ratio in the direction of a high compression ratio takes place in that, in a first step, the adjusting shaft is moved in a second direction opposite to the direction in which there has been a movement to low compression during adjustment. In a second method step, the spring between the adjusting element and the adjusting shaft is tensioned, and, during a time segment, with the crank mechanism of the associated cylinder being relieved, the spring moves the adjusting element and consequently the pick-up in a further method step. So that the advantage in terms of construction space, of consumption and of cost of a small low-power actuator can be utilized, an adjustment of the compression ratio in the direction of high compression is possible only in a plurality of method steps, since this takes place counter to an increased load which results from the gas force. An adjusting operation is initiated at any desired time point by the movement of the adjusting shaft, in that a spring between the adjusting shaft and the adjusting element is tensioned. This may be a tension or compression spring. During this operation, the actuator has to overcome only the spring force of this spring. A movement of the adjusting element by a stop on the adjusting shaft does not occur. Owing to the growing profile of the gas force and consequently also the force which has to be overcome in order to achieve a high compression ratio, the force profile likewise grows in an apparatus which brings this about. This means that a force of the pick-up on the adjusting element likewise is growing, since the pick-up varies the compression ratio indirectly or directly. Adjustment in the direction of high compression means that the pick-up is moved, opposite to the direction of its force on the adjusting element, by a movement of the adjusting element. This movement takes place in the time segments in which the growing force of the pick-up on the adjusting element has a minimum or negative values and is triggered by the pre-tensioned spring. The movement of the adjusting element and consequently also of the pick-up may take place in one or more part steps and is dependent on the spring force and on the duration of the time segment having a minimum of the growing force. A strong spring also moves the adjusting element in a short time segment, but requires a strong actuator. The force of the pick-up on the adjusting element can be broken down into a force normal to the face and an axial force in the direction of the adjusting shaft. The spring is designed such that, during adjustment in the direction of high compression, it overcomes the axial force and frictional forces possibly occurring, and an excess force still remains for adjustment. The movement of the adjusting element on account of the spring force takes place until the adjusting element bears against a stop.

In a further refinement of the method, different highest or lowest compression ratios are set by means of different positions of the adjusting shaft and of the associated stops by means of the actuator. Since the actuator does not move the adjusting element as far as a possible end position, but makes it possible to set intermediate values by means of the stops, it is possible to set any desired inter-mediate value for the compression ratio. For this purpose, an exact activation of the actuator movement and adjusting shaft movement is required, which is provided by a control unit, for example via the angle of rotation of the adjusting shaft.

In a further refinement of the method according to the invention, a variation of the profile, the size and/or the shape of the valve stroke curve of the gas exchange valves takes place in that, in a first method step, the actuator moves the adjusting shaft and, thereafter, the adjusting element, pretensioned by spring force, presses against the pick-up. In a further method step, the adjusting element is adjusted counter to the force of the pick-up at a time point with a low counterforce by the lever on the adjusting element. In a last method step, the adjusting element is moved as far as a stop and remains there in a stable position. In the valve drive of an internal combustion engine, the force, which acts between a cam of a camshaft and a gas exchange valve via tapped push rods, levers or other transmission elements, assumes a growing profile. In time segments in which the valve is closed and the force action point on the cam runs on what is known as the base circle of the cam, the force in the active chain is very low and only such that a rattling or lift-off the individual elements is avoided. During these time segments, it is possible, without major forces, to vary a component in the active chain such that a variation of the valve stroke curve occurs. This takes place in that the adjusting element in the form of an eccentric or of a cone is moved such that the pick-up touches the large outside diameter of the adjusting element in the end position of the latter. However, in order to initiate an adjusting operation independently of the piston position in the cylinder and independently of the valve position, it is necessary to carry out the adjusting operation in a plurality of steps. This is achieved by pretensioning the spring at a desired time point and by triggering the adjusting operation by the displacement of the adjusting element by means of the pretensioned spring at a time segment with a low counter-force of the pick-up on the adjusting element. The displacement of the adjusting element takes place as far as the associated stop. Displacement may occur in a continuous movement or in a plurality of interrupted movements. The movement may be interrupted, for example, in that the force of the pick-up on the adjusting element is so high on account of the valve stroke curve that the spring of the adjusting device is no longer capable of displacing the adjusting element.

In a further refinement of the method according to the invention, a variation of the profile, the size and/or the shape of the valve stroke curve of the gas exchange valves takes place, in a second version, in that, in a first method step, the actuator moves the adjusting shaft and the stop butts against the adjusting element. In a further method step, the adjusting shaft displaces the adjusting element into a second position by means of the stop, the movement being assisted by the pick-up, and the actuator having to overcome exactly the self-locking between the pick-up and the adjusting element. In the event of a movement of the pick-up on the adjusting element, which is assisted by the force of the pick-up on the adjusting element on account of the direction of the oblique face on the latter, only a low actuator power is necessary for this purpose. On account of the self-locking, automatic or unregulated adjustment is avoided.

Further features and feature combinations may be gathered from the description and the drawings. Actual exemplary embodiments of the invention are illustrated in simplified form in the drawings and are explained in more detail in the following description with reference to the accompanying drawings.

DESCRIPTION OF PARTICULAR EMBODIMENTS

Figure 1:
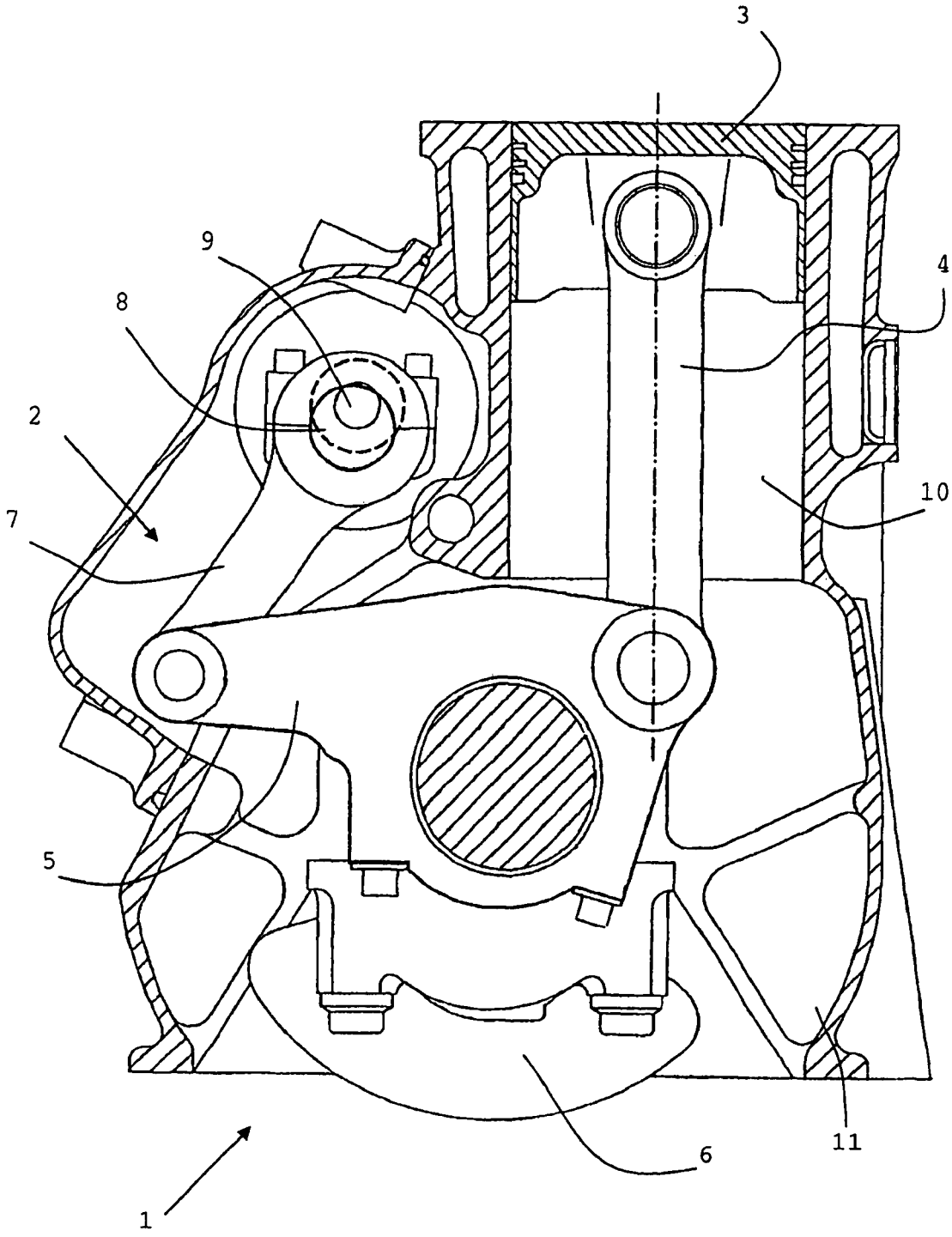
FIG. 1 shows an internal combustion engine with an apparatus for adjusting the compression ratio and with an adjusting apparatus according to the invention.

FIG. 1 shows an internal combustion engine 1 which has an apparatus 2 for varying the compression ratio. The internal combustion engine has a piston 3 which is connected to a crankshaft 6 via a main connecting rod 4 and a transverse lever 5 and which converts the gas force acting on the piston into a rotational movement of the crankshaft. Furthermore, the transverse lever 5 is supported via a secondary connecting rod 7 by an eccentric 8. The eccentric 8 is mounted on an adjusting shaft 9. As the eccentric 8 is rotated, the secondary connecting rod 7 is displaced, with the result that the transverse lever 5, in turn, is pivoted.

As a result, the position of the piston 3 in the cylinder 10 is changed via the main connecting rod 4, the compression ratio thereby being adjusted. During an upward movement of the piston, the compression ratio rises, and, in a downward movement, the compression ratio decreases, if it is presupposed that the crankshaft 6 maintains its position in the crankcase 11. By choosing suitable lever lengths of the main and the secondary connecting rod and of the trans-verse lever, the compression ratio can be changed by means of small eccentric movements. During combustion, the gas pressure acts via the piston 3 on the crankshaft 6 and also via the transverse lever 5 and the secondary connecting rod 7 on the eccentric 8 and the adjusting shaft 9. An adjustment in the direction of low compression is therefore assisted by the gas force which, however, on account of the self-locking between the eccentric 8 and adjusting shaft 9, cannot automatically adjust the eccentric. During adjustment in the direction of high compression, the adjusting shaft 9 and the eccentric 8 must be adjusted counter the action of the gas force. Since the gas force and also the mass force have a strongly growing profile on account of the oscillating piston movements, adjustment takes place in the time segments in which the gas and the mass force have a minimum value.

Figure 2:
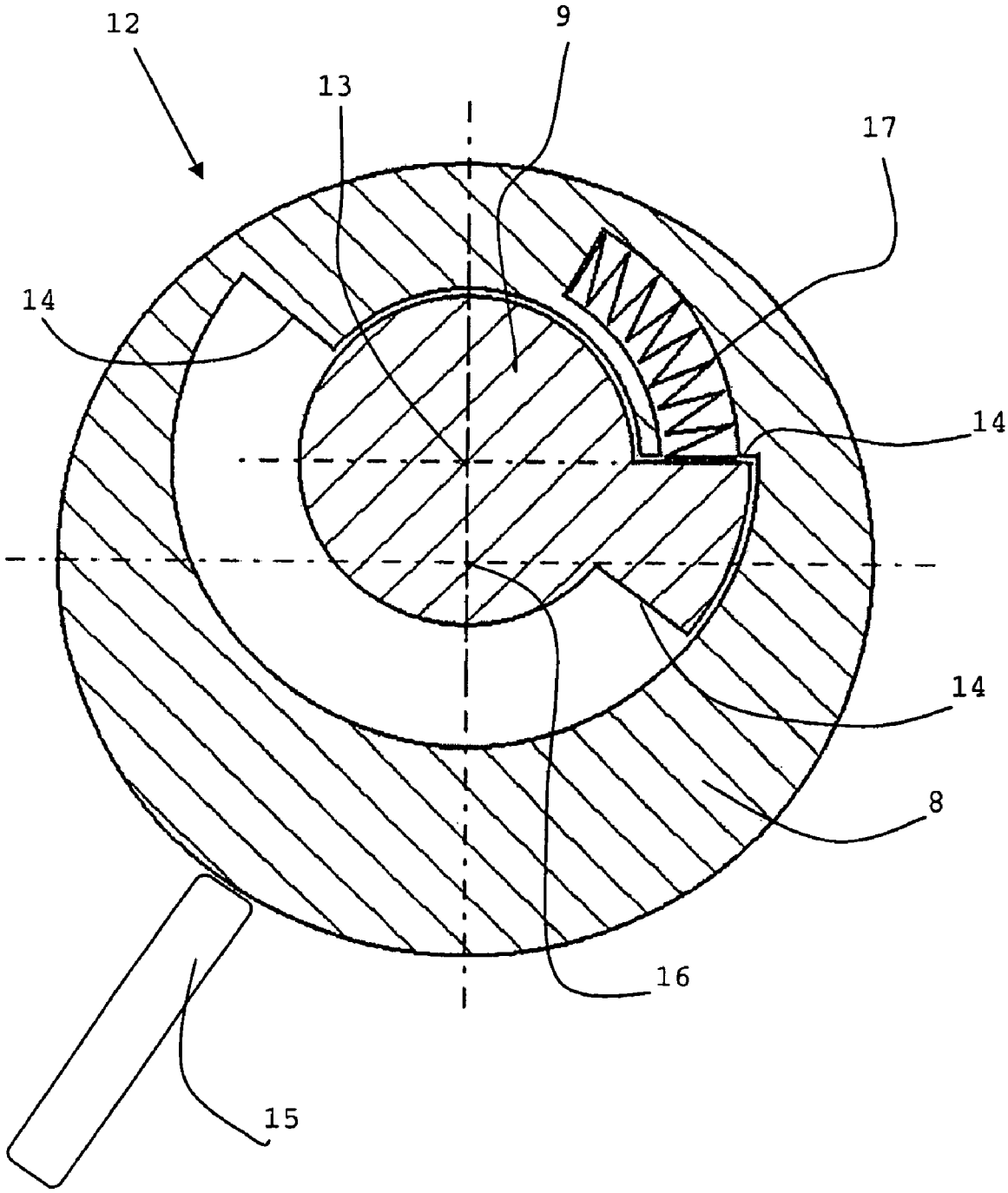
FIG. 2 shows an adjusting apparatus according to the invention with an eccentric.

FIG. 2 shows the adjusting apparatus 12 consisting of the eccentric 8 and of the adjusting shaft 9. The eccentric 8 is mounted rotatably about a center axis 13 of the adjusting shaft and has a range of angle of rotation of less than 180°. The angle of rotation is limited in both directions by stops 14 fixed to the eccentric and fixed to the adjusting shaft. During the rotation of the eccentric 8 about the center axis 13, the distance between a pick-up 15, which slides or rolls along the surface of the eccentric, and the center 13 is changed. The pick-up 15 may be designed as a tappet, or it surrounds the eccentric 8 in a similar way to that in which a connecting rod surrounds a crankpin of a crankshaft. In an arrangement as in FIG. 1, the pick-up 15 is designed as a secondary connecting rod 7. That is to say, the variable distance between the center 13 and the pick-up 15 is used for adjusting the compression ratio, and the pick-up is pressed onto the eccentric 8 by means of a gas force effective on the piston 3 and transmitting proportionately according to the leverages. The distance between the center 13 of the adjusting shaft and the eccentric center 16 determines the possible pick-up movement, but also the gradient of the movement over the angle of rotation. With a low gradient, that is to say, a small change in distance between the center 13 of the adjusting shaft and the eccentric center 16 with a certain angle of rotation of the eccentric 8, self-locking occurs between the pick-up 15 and the eccentric 8. Between the eccentric 8 and the adjusting shaft 9, a tension spring 17 is arranged which pulls the eccentric towards the adjusting shaft up to a stop. In one version, not shown, a compression spring is also possible as an adjustment aid.

The compression ratio of the internal combustion engine may be adjusted anywhere between a high to a low compression ratio.

During the adjustment of the compression ratio to a low ratio, a rotation of the eccentric 8 takes place such that the pick-up 15 approaches the center 13 of the adjusting shaft 9, that is to say it moves downhill on an oblique face of the eccentric 8 as the eccentric is rotated. Because of the self-locking between the pick-up 15 and the eccentric, movement does not take place automatically. An adjusting operation is initiated by the counterclockwise rotation of the adjusting shaft 9 in FIG. 2. The adjusting shaft 9 is rotated by an actuator, not shown, such as, for example, an electric motor. The rotation of the adjusting shaft 9 is transmitted to the eccentric 8 via the stops 14 adjacent to the tension spring 17. Since, in the event of adjustment in the direction of low compression, the movement is not impeded by the force of the pick-up 15 on the eccentric 8, but rather is assisted thereby, it is sufficient to dimension the actuator such that it reliably overcomes the friction of the overall adjusting apparatus 12.

Adjustment of the compression ratio to a high value means that the pick-up 15 is moved counter to the gas pressure on the piston in the combustion chamber. The pick-up 15 is moved away from the center 13 of the adjusting shaft 9. For adjustment at a desired time point, a very strong actuator will be required, which, in the most unfavorable case, should be capable of adjusting the eccentric 8 and the pick-up 15 counter to the combustion gas pressure. Since the gas force arising from combustion has a highly fluctuating profile which may even assume negative values during the intake stroke, it is particularly advantageous to carry out adjustment counter to the gas force in time segments in which the gas force is low or, if appropriate, zero. So that a low-power and therefore lightweight and cost-effective actuator can be used, adjustment in the direction of high compression is carried out, according to the invention, in at least two partial steps.

For this purpose, in a first step, the adjusting shaft 9 is rotated clockwise in FIG. 2 to a final value corresponding to the desired compression ratio, but at most up to the contact of the two stops 14 lying opposite the tension spring 17. This may take place at a desired time point. In this case, the tension spring 17 is tensioned, the actuator having to overcome only the system friction and the spring force of the tension spring. During a time segment with a low gas force or in the case of a gas force minimum, the tension spring 17 is capable of rotating the eccentric 8 clockwise and at the same time of moving the pick-up 15. A rotation of the eccentric 8 takes place as long as the force of the tension spring 17 is higher than the fraction of the force of the pick-up 15 in the tangential direction. If the gas force rises and the tangential fraction rises correspondingly, the eccentric 8 does not rotate any further. Further rotation up to the contact of the stops 17 adjacent to the tension spring 17 then takes place in the next recurring combustion stroke of the internal combustion engine when the gas force again reaches a minimum. Consequently, a high compression ratio is set at the latest after a few revolutions of the internal combustion engine, without an excessively strong actuator being required.

Figure 3:
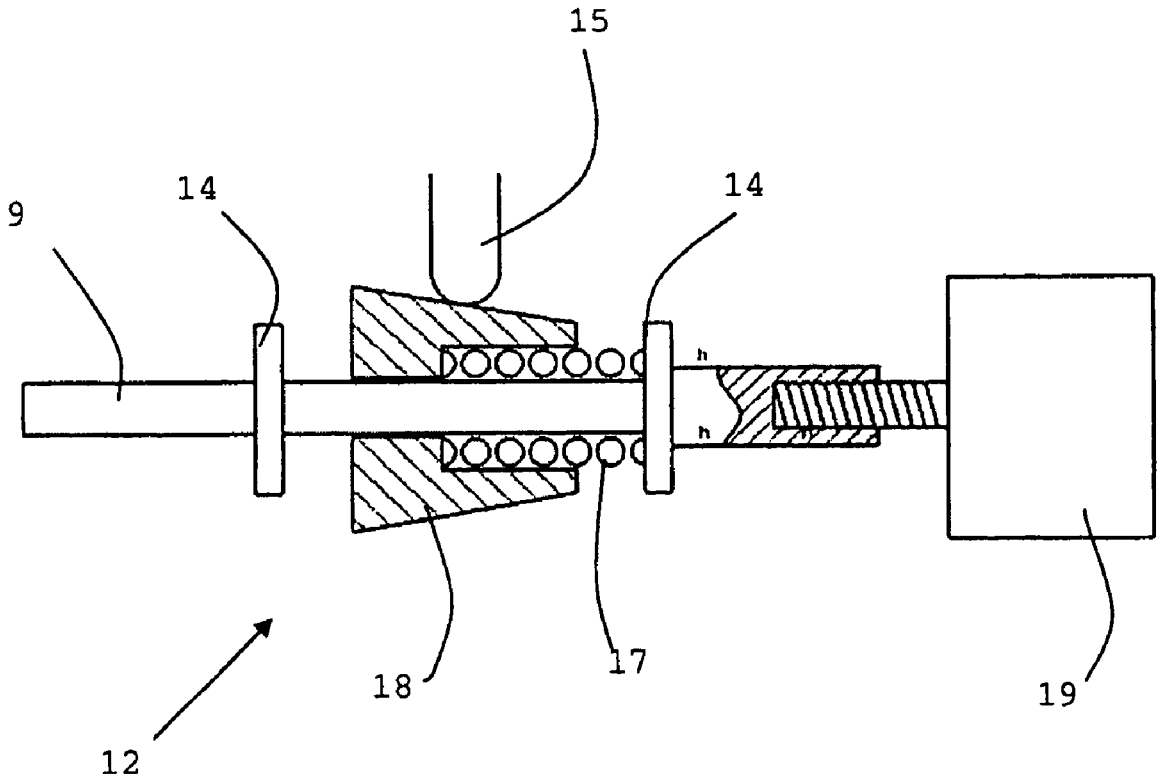
FIG. 3 shows an adjusting apparatus according to the invention with a cone.

FIG. 3 shows an adjusting apparatus 12 according to the invention with a cone 18. Correspondingly to the version in FIG. 2, in which adjustment is brought about by a rotational movement, in the adjusting apparatus 12 adjustment is caused by a translational movement. The adjusting apparatus has an actuator 19 which displaces the adjusting shaft 9 in the longitudinal direction. On the adjusting shaft 9 are arranged two stops 14, between which the longitudinally displaceable cone 18 is located as an adjusting element. The cone 18 is connected by means of a tension spring 17 to that of the two stops 14 which is on the right. A pick-up 15 slides or rolls on the cone 18 and transfers a movement, caused by a displacement of the cone, to an apparatus, not shown. As result of the movement of the pick-up 15, any desired apparatus for adjusting the compression ratio or else an apparatus for varying a valve stroke curve of a gas exchange valve can be adjusted. The cone 18 has such a small cone angle that self-locking occurs between the pick-up 15 and the cone. That is to say, the cone 18 is not displaced by the force of the pick-up 15 on the cone. Displacement of the cone 18 takes place only by triggering by the actuator 19. The actuator 19, in turn, is activated by a control unit, not shown, and is designed, for example, as an electric motor.

For an adjustment of the pick-up 15, the operations of the rotational movement of the apparatus from FIG. 2 are converted in a similar way to translational movements. The actuator 19 is pressed with a growing force onto the cone 18. A displacement of the cone 18 in FIG. 3 to the left (the pick-up point of the pick-up 15 is displaced from a large to a small diameter of the cone) requires only a low force of the actuator 19, since only the friction of the adjusting apparatus 12 has to be overcome. The force of the pick-up 15 on the cone 18 assists the movement of the cone to the left. Consequently, a displacement of the cone 18 is possible even if the maximum force is effective on the pick-up 15. This force originates from the gas pressure of the combustion gases or a spring force in the case of a high valve stroke of a gas exchange valve and has a sharply growing profile.

For adjustment counter to this force (the pick-up 15 is in this case moved from a small to a large diameter of the cone 18 or the cone is displaced to the right in FIG. 3), the method is divided into a plurality of part steps. In a first part step, the actuator 19 moves the adjusting shaft 9 to the right in FIG. 2 and at the same time tensions the tension spring 17. This part step may take place at any desired time point as determined by a control unit, not shown. If the force of the pick-up 15 on the cone 18 at this time point is too high on account of the gas force profile or of the valve spring force, the cone remains in its position. At the moment when the force of the pick-up 15 on the cone 18 drops below a certain value and, as a consequence, a resulting retaining force in the longitudinal direction of the adjusting shaft 9 becomes lower than the spring force of the tension spring 17, the cone 18 is pulled to the right by the tension spring and the pick-up 15 is moved onto a large cone diameter.

The cone 18 may rotate about the adjusting shaft 9, but it may also be connected fixedly in terms of rotation to the latter. A version is conceivable, furthermore, in which there is not a cone 18, but a wedge, which can be displaced by the adjusting shaft 9 purely in translation without any rotational movement. Furthermore, it is possible to replace the tension spring 17 by a compression spring which, however, is arranged on the opposite side of the cone 18. The spring may be designed as a mechanical, electric, hydraulic or pneumatic spring.

What is claimed is:

1. An adjusting apparatus (12) for adjusting the position of a device subject to a fluctuating force, particularly in an internal combustion engine (1), comprising: an engine block (11) with cylinders arranged in the engine block (11), and a crankshaft (6) with a crankshaft, and pistons (3) movably disposed in the cylinders (1), said adjusting apparatus (12) including for each cylinder (10) the following elements:

a pickup (15) connected to an adjustment element for a position adjustment thereof and being seated on an inclined surface with a variable force so that the pick-up is self-locking, that is, the adjustment element is moveable only when the engagement force of the pickup (15) drops below a certain value, the adjustment element being movably supported on an adjusting shaft (9) and being spring-biased in one direction of movement.

2. The adjusting apparatus as claimed in claim 1, wherein the adjusting shaft (9) is movable at least in one of a translational and a rotational sense by means of an actuator (19).

3. The adjusting apparatus as claimed in claim 1, wherein stops (14) are provided for limiting movement of the adjusting element on the adjusting shaft (9).

4. The adjusting apparatus as claimed in claim 1, wherein a spring (17) is provided which assists the movement of the adjusting element on the adjusting shaft (9) in one direction.

5. The adjusting apparatus as claimed in claim 1, wherein the adjusting element is an eccentric (8) which is arranged rotatably on the adjusting shaft (9).

6. The adjusting apparatus as claimed in claim 1, wherein the adjusting element is a cone or wedge segment (18) which is arranged axially displaceably on the adjusting shaft (9).

7. The adjusting apparatus for an internal combustion engine as claimed in claim 6, wherein an adjustable cylinder segment forms a structure for adjusting the profile, size and/or shape of a valve stroke curve of gas exchange valves.

8. The method for operating an adjusting apparatus for an internal combustion engine as claimed in claim 7, wherein a variation of the profile, the size and/or the shape of the valve stroke curve of the gas exchange valves takes place in that the actuator (19) moves the adjusting shaft (9), the adjusting element, pretensioned by spring force, presses against the pick-up (19), the adjusting element is adjusted at a time point with a low counterforce of the pick-up (9) on the adjusting element, the adjusting element is moved as far as a stop (14) and remains there in a stable position.

9. The method for operating an adjusting apparatus for an internal combustion engine as claimed in claim 7, wherein a change of at least one of the profile, the size and the shape of the valve stroke curve of the gas exchange valves takes place, in that the actuator (19) moves the adjusting shaft (9), the stop abuts the adjusting element and displaces the latter into a second position, the movement being assisted by the pick-up (15), the actuator (19) having to overcome the self-locking between the pick-up (15) and the adjusting element.

10. The adjusting apparatus as claimed in claim 1, wherein the adjustable device of a cylinder segment forms an apparatus (2) for adjusting the compression ratio of an internal combustion engine having a cylinder with a piston (3) movably disposed therein and connected to a crankshaft (6) by a connecting rod (4), in which at least one of the length of a connecting rod (4), the stroke of the crankshaft (6) and further components determining the compression ratio are changed by means of the pick-up (15) and intermediate members.

11. The adjusting apparatus for an internal combustion engine as claimed in claim 10, wherein end positions of the angle of rotation which are determined by stops (14) correspond to a highest and a lowest compression ratio of the internal combustion engine (1).

12. A method for operating an adjusting apparatus for an internal combustion engine as claimed in claim 10, wherein, a variation of the compression ratio in the direction of a low compression ratio takes place in that the adjusting shaft (9) is moved in a first direction and moves the adjusting element by means of a stop (14), the gas force arising from combustion in the cylinder above the piston (3) assisting the movement of the adjusting element via the pick-up (15).

13. The method for operating an adjusting apparatus for an internal combustion engine as claimed in claim 12, wherein a change of the compression ratio in the direction of a high compression ratio takes place in that the adjusting shaft (9) is moved in a second direction which points opposite to the first direction, the spring (17) between the adjusting element and the adjusting shaft (9) is tensioned, and, during a time segment, in which the crank mechanism of the associated cylinder (10) is relieved, the spring (17) moves the adjusting element.

14. The method for operating an adjusting apparatus for an internal combustion engine as claimed in claim 12, wherein different highest or lowest compression ratios are set by means of different positions of the adjusting shaft (9) and of the associated stops (14) by means of the actuator (19).

* * * * *